United States Patent [19]

Eigenmann

[11] 4,411,553

[45] Oct. 25, 1983

[54] RETRO-REFLECTING GLOBULES FOR ROAD SURFACE MARKING

[76] Inventor: Ludwig Eigenmann, POB 8, CH 6833 Vacallo, Switzerland

[21] Appl. No.: 265,231

[22] Filed: May 19, 1981

Related U.S. Application Data

[63] Continuation of Ser. No. 54,235, Jul. 2, 1979, abandoned.

[30] Foreign Application Priority Data

Jul. 5, 1978 [IT] Italy ..... 25381 A/78

[51] Int. Cl.[3] ..... E01F 9/04

[52] U.S. Cl. ..... 404/16; 350/105

[58] Field of Search ..... 404/16, 14, 15, 13, 404/9; 116/63 R; 350/97, 105

[56] References Cited

U.S. PATENT DOCUMENTS

| | | | |
|---|---|---|---|
| 1,789,525 | 1/1931 | Hoff | 404/15 |
| 3,114,597 | 12/1963 | Lee | 404/15 |
| 3,240,132 | 3/1966 | Wiswell | 404/16 |
| 3,277,800 | 10/1966 | Wiswell | 404/16 |
| 3,575,092 | 4/1971 | Freeman | 404/14 X |
| 3,964,821 | 6/1976 | Eigenman | 404/9 X |
| 4,049,337 | 9/1977 | Eigenman | 404/9 X |
| 4,069,281 | 1/1978 | Eigenman | 404/16 X |
| 4,072,403 | 2/1978 | Eigenman | 404/6 X |

*Primary Examiner*—Nile C. Byers, Jr.
*Attorney, Agent, or Firm*—Michael J. Striker

[57] ABSTRACT

Improved retro reflecting globules of vertically asymmetrical configuration and of geometry such as to provide at least another asymmetry in plan view, to provide an optimum light response to light beams impinging under differing zenithal and azimuthal angles.

3 Claims, 6 Drawing Figures

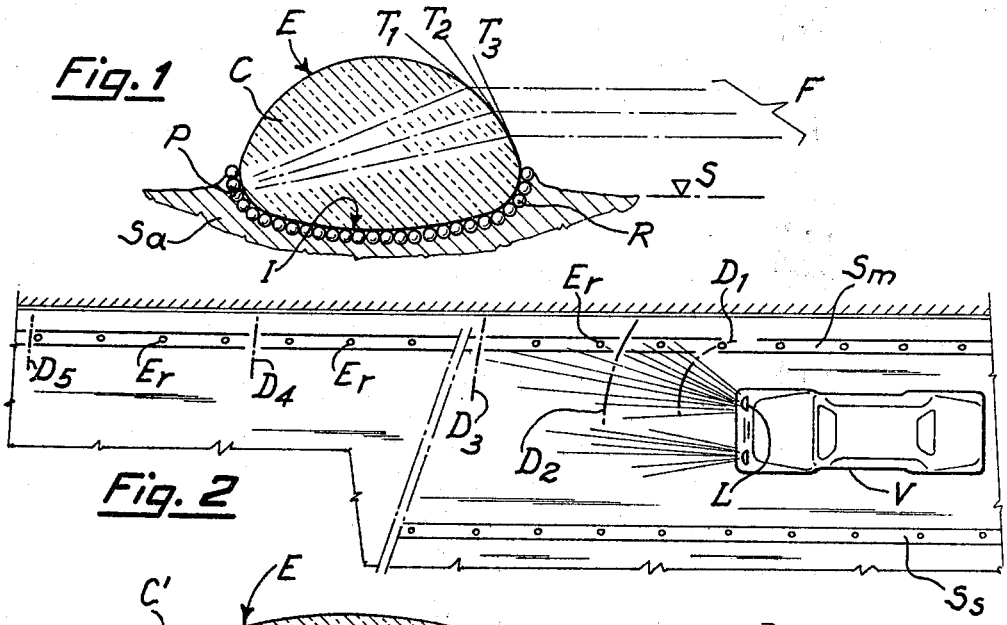
Fig. 1
Fig. 2
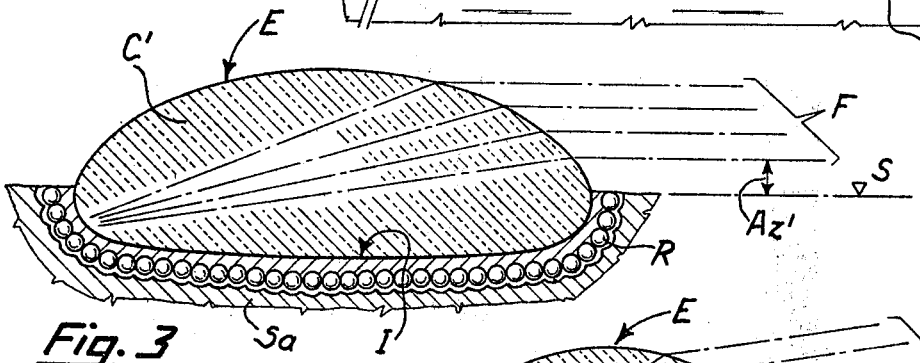
Fig. 3
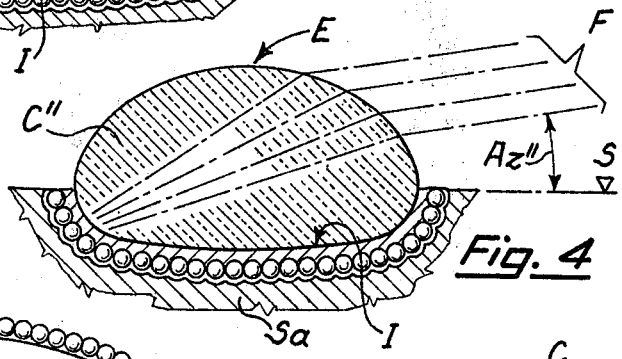
Fig. 4
Fig. 5
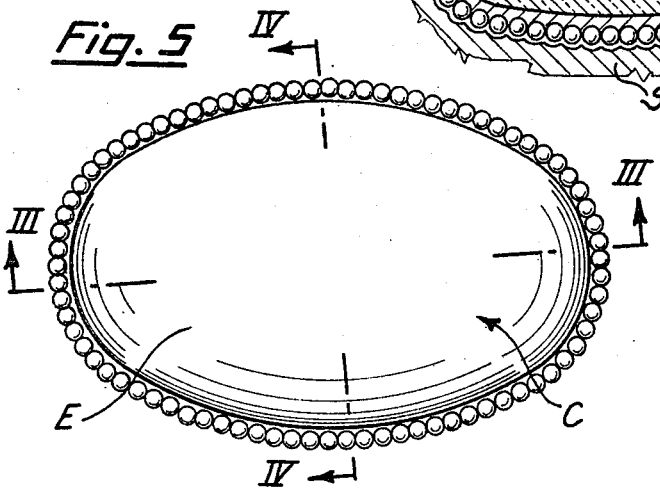
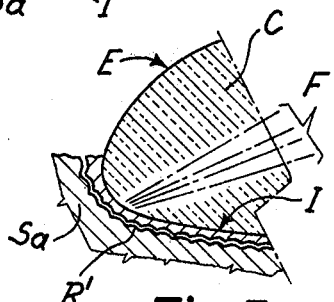
Fig. 6

RETRO-REFLECTING GLOBULES FOR ROAD SURFACE MARKING

This is a continuation, of application Ser. No. 054,235, filed July 2, 1979, and now abandoned.

BACKGROUND OF THE INVENTION a. The Field of the Invention

The present invention is generally concerned with the art of road surface traffic regulating signs and markings more particularly with retro reflecting elements for providing night time visibility to horizontally located markings laid or formed on road surfaces, such as traffic lane dividing lines, pedestrian crossings or other signs and markings, as well as lane edge defining lines;

b. The Prior Art

This art is well known and a well worked one and a wide patent literature is available thereon. The forming of and providing sharp night time visibility at distance to traffic lane dividing and edge defining lines is essential for traffic safety. In the specification of the U.S. Pat. No. 3,587,415 granted to the instant applicant (U.K. Pat. No. 1,245,834) the utility and the principles of retro reflective road marking materials have been set forth. An analysis about the optics of retro reflecting elements including each a spherical transparent globule having a mono layer of reflectorized microspheres associated thereto has been disclosed in the applicant's U.S. Pat. No. 3,894,791 (U.K. Pat. No. 1,343,196).

This art has been consistently improved and even more efficient retro-reflective elements comprising globules either of glass or of optically transparent resins have been proposed and devised. The applicant's U.S. Pat. No. 4,072,403 which is hereby incorporated by reference has set forth an improved retro reflecting assembly comprising a not spherically symmetrical transparent resinous globule having a surface subdivided into a generally part spherical part, a second generally flat part, and a third annular and outwardly convex part between said first and second part, said first part being uncoated and having a predetermined relatively large radius of curvature, said third part having at least one radius of curvature substantially smaller than said large radius, and a monolayer of externally reflective transparent microspheres covering all of said third part and at least a portion of said second part, said microspheres each being only fractionally as large as said globule.

The said globules consist of a transparent polymeric material having a refractive index preferably comprised from about 1.45 to 1.68. This material preferably consists of a polymethylmetacrylate, or a copolymer of methylstyrene and methylmetacrylate, or a copolymer of styrene and acrylonitrile, or a polycarbonate, or also of an epoxy copolymer.

The same U.S. Pat. No. 4,072,403 has also set forth an improved process for manufacturing said asymmetrical globules, said process comprising the steps of forcedly passing a sheet of transparent thermoplastic polymeric material between adjacent counter-rotating calendering rollers having die forming recesses evenly and closely arranged on their cylindrical surfaces to produce upon the action of heat and pressure, an intermediate essentially planar asymmetrical globules article comprising pluralities of essentially part spherical and respectively of rather flat bulges oppositely located at either faces of a plane defined by thin and easily breakable sheet portions which interconnect the asymmetrical globules formed by each pair of oppositely located part spherical and respectively rather flat bulges. This planar asymmetrical globules article for the retro-reflecting use on the road surface is cut into slices or is subject to breaking. In order to separate the individual retro reflecting globules the rather flat bottom is of enormous importance for the best impact resistance to the traffic abuse.

It is evident that the geometry of the bulges and therefore of the globule depends from that of the die forming recesses of which the said calendering rollers had been provided and therefore that no practical limitation exists about the selection of such geometry.

Essentially, the further improved retro reflecting globule has, additionally to one first vertical asymmetry condition relatively to the plane in which the globule in service is secured on the road surface, at least a horizontal asymmetry condition relatively to at least another plane perpendicular to the first mentioned plane.

Particularly, the retro-reflecting globule has a non circular configuration when seen from above in said road surface. More particularly, said non circular configuration is elongated, still more particularly elliptical.

These and other objects and features of the invention will now be made apparent from the following detailed description of preferred embodiments of same invention, taken together with the accompanying drawing;

THE VIEWS OF THE DRAWING

FIG. 1 is a somewhat diagrammatical and greatly enlarged vertical sectional view of the improved globule on a carrying and anchoring layer;

FIG. 2 is a fragmentary diagrammatical plan view of a road surface provided with road surface marking system comprising a traffic lane edge defining line and of a motor vehicle having conventional headlamps for near and far night time illumination;

FIGS. 3 and 4 are vertical sectional views, taken in planes indicated at III—III and respectively at IV—IV in FIG. 5, of an improved embodiment of the globule of FIG. 1, FIG. 5 is a plan view of the globule, and FIG. 6 is a fragmentary vertical sectional view of one of the several feasible structures of the globule.

DETAILED DESCRIPTION OF THE PREFERRED EMBODIMENTS

Referring now to the drawing, an improved retro reflecting globule according to the invention comprises the features essentially illustrated in FIG. 1. Such globule comprises a primary transparent body C having a rounded essentially dome shaped outer surface portion and a properly inner portion I having a relatively shallow geometry, said portion I being coated at least at its periphery with a reflecting monolayer R of microspheres, said monolayer being externally coated with a thin inwardly reflective layer of silver or aluminium, for example. This structure is illustrated in somewhat greater detail in FIGS. 3 and 4.

In the modified embodiment of FIG. 6 the inwardly reflecting monolayer R′ comprises a plurality of closely arranged concavities or other geometrical configurations, such as tetrahedrons, adapted for retroreflect of the light which has passed through the transparent primary body.

The globule in service is firmly anchored to a carrying layer Sa; the surface S defining the face over which the uncoated external portion E of the globule protrudes for light impingement. The carrying layer Sa is actually formed by the very road surface marking and it can consist of a paint applied and set on the road pavement, of a resinous tear and wear resisting layer or of a prefabricated road marking tape material, the art of providing road surface markings having retro reflective elements secured thereto being a well known and worked one.

The globule has an oppositely located bulge forming portions E and I which are asymmetrical relatively of the plane defined by the surface S, the bulging of external portion E designed for light impingement being relevant relatively to the downwardly turned bulging of the rather flat internal portion I, which can be anchored into a rather thin but highly stress resistant resinous carrying layer Sa such as of polyurethane, for example.

In the globule improved according to the invention, the paths of the light rays within the primary body until impingement at reflection position P, can be substantially longer than the radii of curvature at locations $T_1$, $T_2$, $T_3$ opposite to said position.

Provided the geometry of the cross section of the body C, in any vertical plane including a beam (FIGS. 1, 3 and 4) of impinging grazing light position retro reflection can be attained under very differing vertical or zenithal angles taking into account the height from the ground of the vehicle carried sources of light (the headlamps). In other terms, the retro reflecting globules can provide positive visibility at very differing distances and angles.

FIGS. 3 and 4 illustrate examples of such geometry, resulting by the elongation of the globule, as shown in plan view in FIG. 5. For example a primary globule C', when impinged by a light beam F in the vertical sectional plane indicated at III—III in FIG. 5, provides retro reflection under a little zenithal angle Az', while the smaller elongation of FIG. 4, in the plane IV—IV provides positive retro reflection under a somewhat greater zenithal angle Az''. Therefore, the geometry of FIG. 3 provides positive visibility at a distance greater than that of FIG. 4.

FIG. 2 illustrates a typical situation in which a motor vehicle V having operating headlamps L travels along a conventional road provided with a side edge defining line Sm and for example at least a traffic lane dividing line Ss the vehicle is regularly travelling between said lines Sa and Ss, parallely thereto and at a somewhat distance therefrom. The light beams irradiated by the light sources L (see in particular the righthand headlamp) impinge the retro reflecting elements Er provided on and along the lines, namely the edge defining line at differing distances $D_1$, $D_2$, $D_3$, $D_4$, $D_5$ not only under differing horizontal or azimuthal angles according to the lateral distance of the vehicle from the line but also under differing vertical or zenithal angles, according to the height of the headlamps over the ground. Therefore in each retro-reflecting element Er very differing optical situations occur comprised between that of FIG. 3 (greatest distance) and that of FIG. 4 (smaller distance).

I claim:

1. A retro-reflecting assembly for traffic regulating surface markings on roadway pavements, comprising a transparent globule having a body of essentially convexly curved irregular shape, said body including an upper portion to be exposed to light impingement and a bottom portion having a bottom surface; and a monolayer of reflecting transparent microspheres for retro-reflecting light beams, said monolayer being connected to said bottom surface of said bottom portion, said bottom portion being relatively shallower than said upper portion, said upper portion merging into said bottom portion so that a cross-section in a horizontal plane extending between said upper portion and said bottom portion has a configuration with two mutually perpendicular axes which go through a bearing center of said cross-section and of which one axis is of a greater length than the length of the other of said axes, whereby an optimal light response of said body to light beams impinging on said body under different vertical and horizontal angles is obtained.

2. The retro-reflecting assembly of claim 1, wherein said upper portion is defined by a generatrix outlined with a curvature having differing radii in a vertical cross-section of said upper portion to provide reflective deviations of impinging light under different zenithal angles of impingement.

3. The retro-reflecting assembly of claim 1, wherein said configuration is essentially elliptical.

* * * * *